US009033112B2

(12) United States Patent
Koba

(10) Patent No.: US 9,033,112 B2
(45) Date of Patent: May 19, 2015

(54) ELEVATOR GROUP CONTROL SYSTEM

(75) Inventor: Yoshimasa Koba, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 705 days.

(21) Appl. No.: 13/395,909

(22) PCT Filed: Nov. 27, 2009

(86) PCT No.: PCT/JP2009/070017
§ 371 (c)(1),
(2), (4) Date: Mar. 14, 2012

(87) PCT Pub. No.: WO2011/064877
PCT Pub. Date: Jun. 3, 2011

(65) Prior Publication Data
US 2012/0175195 A1 Jul. 12, 2012

(51) Int. Cl.
*B66B 1/18* (2006.01)
*B66B 1/24* (2006.01)

(52) U.S. Cl.
CPC ..... *B66B 1/2458* (2013.01); *B66B 2201/103* (2013.01); *B66B 2201/211* (2013.01)

(58) Field of Classification Search
CPC ..... B66B 1/2458; B66B 2201/103; B66B 2201/211; B66B 2201/215; B66B 2201/22; B66B 2201/223
USPC ..... 187/247, 380–389, 391–393
See application file for complete search history.

(56) References Cited

U.S. PATENT DOCUMENTS

| | | | | |
|---|---|---|---|---|
| 4,691,808 | A | 9/1987 | Nowak et al. | |
| 4,901,822 | A * | 2/1990 | Tsuji | 187/386 |
| 6,945,365 | B2 * | 9/2005 | Matela | 187/382 |
| 7,083,027 | B2 * | 8/2006 | Siikonen et al. | 187/383 |
| 8,505,693 | B2 * | 8/2013 | Koba | 187/387 |
| 8,573,366 | B2 * | 11/2013 | Elomaa et al. | 187/387 |
| 8,602,172 | B2 * | 12/2013 | Suzuki et al. | 187/382 |
| 8,651,242 | B2 * | 2/2014 | Sarjanen et al. | 187/388 |

(Continued)

FOREIGN PATENT DOCUMENTS

| | | |
|---|---|---|
| CN | 101613043 A | 12/2009 |
| JP | 61 23156 | 6/1986 |

(Continued)

OTHER PUBLICATIONS

U.S. Appl. No. 13/496,048, filed Mar. 14, 2012, Koba, et al.

(Continued)

*Primary Examiner* — Anthony Salata
(74) *Attorney, Agent, or Firm* — Oblon, McClelland, Maier & Neustadt, L.L.P.

(57) ABSTRACT

In a group control system which temporarily assigns a destination call registered from a hall destination call registration device to the car of each elevator and computes a plurality of prescribed kinds of evaluation values for each elevator, as one of the plurality of evaluation values, the priority is calculated whose value is determined according to ease with which the passenger who has registered a destination call from the hall destination call registration device moves in a hall and ease with which a passenger who later registers a destination call from the hall destination call registration device moves in the hall. Thereby, the degree of congestion in a hall is appropriately controlled also in consideration of the movement of the passengers in the hall.

11 Claims, 3 Drawing Sheets

(56) References Cited

U.S. PATENT DOCUMENTS

| | | | | |
|---|---|---|---|---|
| 2009/0159374 | A1* | 6/2009 | Sorsa et al. | 187/383 |
| 2010/0282544 | A1 | 11/2010 | Koba et al. | |
| 2010/0326773 | A1 | 12/2010 | Mitsuda et al. | |
| 2011/0155514 | A1 | 6/2011 | Iwata et al. | |
| 2011/0155515 | A1 | 6/2011 | Suzuki et al. | |
| 2012/0305341 | A1* | 12/2012 | Kuoppala et al. | 187/382 |
| 2013/0264150 | A1* | 10/2013 | Koba | 187/382 |
| 2014/0041968 | A1* | 2/2014 | Tokura | 187/389 |

FOREIGN PATENT DOCUMENTS

| | | |
|---|---|---|
| JP | 63 218484 | 9/1988 |
| JP | 06 092555 | 4/1994 |
| JP | 2010 001142 | 1/2010 |
| WO | 2009 081464 | 7/2009 |

OTHER PUBLICATIONS

International Preliminary Report on Patentability and Written Opinion issued Jul. 19, 2012 in PCT/JP2009/070017 filed Nov. 27, 2009.

Notification of Reason for Refusal issued Aug. 6, 2013 in Japanese Patent Application No. 2011-543054 (with partial English translation).

International Search Report issued Apr. 20, 2010 in PCT/JP09/070017 filed Nov. 27, 2009.

Combined Chinese Office Action and Search Report issued Oct. 10, 2013, in Chinese Patent Application No. 200980162459.9 with English translation of the text of the Office Action and with English translation of category of cited documents.

* cited by examiner

ELEVATOR GROUP CONTROL SYSTEM

TECHNICAL FIELD

The present invention relates to an elevator group control system which performs the operation control of a plurality of elevators.

BACKGROUND ART

In a building and the like where many people use elevators, a plurality of elevators are installed in the same building and group control of these plurality of elevators is performed in order to increase the operation efficiency as a whole. Also, there has been realized a group control system which performs car assignment on the basis of a destination call registered by a passenger before boarding an elevator car through the use of a device for registering both a hall call and a destination call, which is installed in an elevator hall.

As a conventional art of such a group control system, there has been proposed a group control system in which in the case of congestion at an elevator hall, each of the elevators is caused to stop a separate destination floor, whereby what is called the neck-to-neck condition is eliminated to improve the operation efficiency (refer to Patent Literature 1, for example).

As another conventional art, there has also been proposed a group control system which is such that the car of a specific elevator is assigned to a specific destination call so long as the waiting time of a passenger does not become longer than a prescribed value thereby (refer to Patent Literature 2, for example).

CITATION LIST

Patent Literature

Patent Literature 1: Japanese Published Patent Application No. H6-92555

Patent Literature 2: Japanese Examined Published Patent Application Publication No. S61-23156

SUMMARY OF INVENTION

Technical Problem

In conventional group control systems, in determining an assigned car to a destination call, the waiting time of a passenger in an elevator hall is mainly taken into consideration and no consideration is given to how the passenger moves in the hall.

For example, in the group control system described in Patent Literature 1, when the number of passengers who use an elevator on the near side of a hall and congestion is detected, an additional assignment of a destination call may sometimes be performed to an elevator on the far side of the hall. In this case, a passenger who comes to the hall later is blocked in his or her path by other passengers who are waiting on the near side of the hall and spends time in moving in the hall in an unexpected way, with the result that the passenger misses the elevator.

Also, in the group control system described in Patent Literature 2, if the elevator car on the far side of the hall is preferentially assigned to the above-described specific destination call, the elevator on the near side of the hall excellent in convenience may become less used.

The present invention was made to solve the problems described above, and an object of the invention is to provide an elevator group control system for efficiently operating a plurality of elevators which can appropriately control the degree of congestion in a hall also in consideration of the movement of passengers in the hall.

Solution to Problem

An elevator group control system of the present invention is a system which performs operation control of a plurality of elevators. The elevator group control system comprises a hall destination call registration device by use of which a passenger registers his or her destination call before boarding an elevator car, evaluation value computation means which computes a plurality of prescribed kinds of valuation values for each elevator by temporarily assigning a destination call registered from the hall destination call registration device to a car of each elevator, and assigned car determination means which assigns an optimum car to a destination call registered from the hall destination call registration device on the basis of each of the evaluation values computed by the evaluation value computation means. The evaluation value computation means computes, as one of the plurality of kinds of evaluation values, a priority whose value is determined according to ease with which a passenger who has registered a destination call from the hall destination call registration device moves in a hall and ease with which a passenger who later registers a destination call from the hall destination call registration device moves in the hall.

Advantageous Effect of Invention

According to the present invention, in a group control system for efficiently operating a plurality of elevators, it becomes possible to appropriately control the degree of congestion in a hall also in consideration of the movement of passengers in the hall.

DESCRIPTION OF EMBODIMENTS

The present invention will be described in more detail with reference to the accompanying drawings. Incidentally, in each of the drawings, like numerals refer to like or corresponding parts and redundant descriptions of these parts are appropriately simplified or omitted.

First Embodiment

Figure 1:
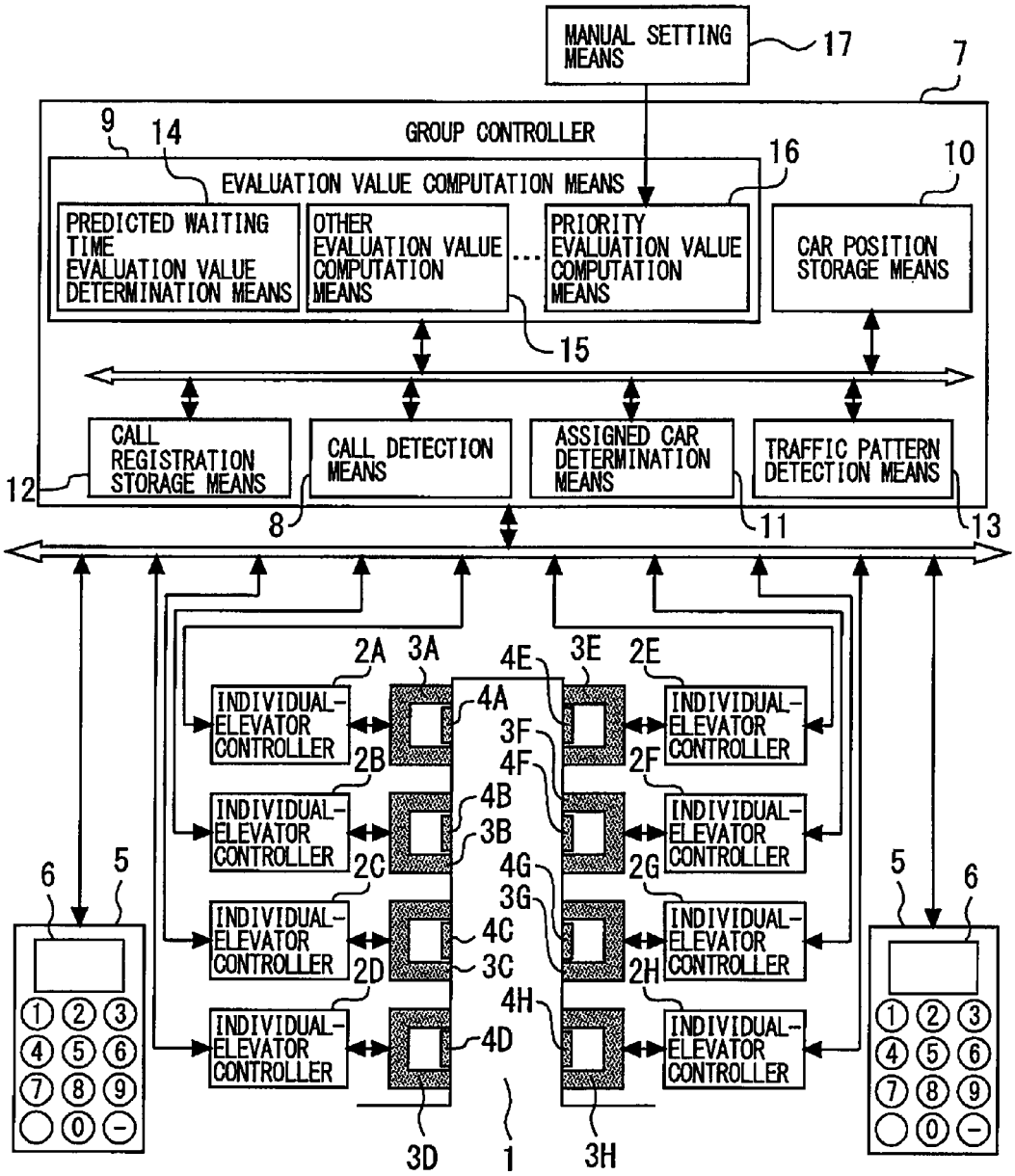
FIG. 1 is a block diagram showing an elevator group control system in a first embodiment according to the present invention.

FIG. 1 is a block diagram showing an elevator group control system in a first embodiment according to the present invention. The elevator group control system shown in FIG. 1 has the function of performing the operation control of a plurality of elevators installed in the same building or the like. In this embodiment, as an example, a description will be given of the case where the group control system performs the operation control of eight elevators, which are Elevators A to H.

In FIG. 1, reference numeral 1 denotes an elevator hall (hereinafter also referred to simply as "hall") provided on a prescribed floor (for example, main lobby) of the above-described building. The elevator hall 1 is provided with the landing entrance of each elevator whose operation control is performed by this group control system.

Reference numerals 2A to 2H denote an individual-elevator controller which controls the operation of each elevator, reference numerals 3A to 3H denote a car of each elevator, and reference numerals 4A to 4H denote a hall door which opens and closes the landing entrance of each elevator. The letters A to H added to reference numerals 2 to 4 denote the Elevator numbers. That is, for the car 3A of Elevator A, the operation of the car, the opening and closing of the door, and the like are controlled by the individual-elevator controller 2A. Also, in the elevator hall 1, the car 3A stops at the landing entrance where the hall door 4A is provided. Incidentally, in the following, when it is unnecessary to make a description for each elevator number, the letters A to H are omitted and those with omitted letters are called the individual-elevator controller 2, the car 3 and the hall door 4.

The elevator hall 1 shown in FIG. 1 is provided with an entrance (serving also as an exit) only in one place, and landing entrances of elevators are arranged in line on both sides from the entrance toward the interior. That is, in the hall 1, landing entrances at which the cars 3D, 3C, 3B, 3A come into a standstill are provided in order on one side as viewed from the entrance, and landing entrances at which the cars 3H, 3G, 3F, 3E come into a standstill are provided in order on the other side. Incidentally, in this embodiment a concrete description will be given of the hall 1 of the above arrangement. However, the arrangement of the hall 1 is not limited to this.

Reference numeral 5 denotes a hall destination call registration device which is provided in the vicinity of the entrance of the elevator hall 1 (including the interior of the hall 1) or outside the hall 1. The hall destination call registration device 5 is a device by use of which an elevator passenger registers a destination call before boarding (the car 3 of) an elevator. That is, the passenger inputs his or her own destination floor from the hall destination call registration device 5, whereby a request for the registration of a prescribed hall call corresponding to the floor on which the hall destination call registration device 5 is arranged and a destination call corresponding to the inputted destination floor is transmitted to a group controller 7, which will be described later.

Reference numeral 6 denotes an indicator (a notification device) provided integrally with the hall destination call registration device 5. This indicator 6 has the function of informing a passenger who has registered a destination call from the hall destination call registration device 5 of an assigned car. That is, when an assigned car for a destination call has been selected in the group controller 7, the assignment information is transmitted to the hall destination call registration device 5 and the information on the car 3 to be boarded is indicated on the indicator 6 to the passenger. Incidentally, it is necessary only that the above-described notification device has the function of the notification of an assigned car and the notification device may also be configured as a device different from the hall destination call registration device 5. In this case, the notification device is installed, for example, in the vicinity of the hall destination call registration device 5.

The group controller 7 has the function of the group control of elevators, i.e., the function of efficiently operating Elevators A to H described above. The group controller 7 constitutes the essential part of this group control system and has the function of appropriately controlling the degree of congestion in the hall 1 also in consideration of the movement of the passengers in the hall 1.

In order to realize each of the above-described functions, the group controller 7 is provided with call detection means 8, evaluation value computation means 9, car position storage means 10, assigned car determination means 11, call registration storage means 12, and traffic pattern detection means 13.

The call detection means 8 has the function of detecting a call registered from the hall destination call registration device 5 (a hall call and a destination call) on the basis of a request for registration received by the group controller 7 and registering the call.

The evaluation value computation means 9 has the function of temporarily assigning a call detected by the call detection means 8 to the car 3 of each elevator and calculating a plurality of prescribed kinds of evaluation values for each elevator which is group-controlled by the group controller 7. For example, this evaluation value computation means 9 computes each evaluation value for each elevator through the use of a prescribed calculating formula and the like, by obtaining information on the current position of the each car 3 from the car position storage means 10.

Incidentally, concrete functions of the evaluation value computation means 9 will be described later.

The assigned car determination means 11 has the function of assigning an optimum car 3 to the call detected by the call detection means 8 on the basis of each evaluation value for each elevator, which is calculated by the evaluation value computation means 9. Specifically, the assigned car determination means 11 calculates the total of each evaluation value (assignment evaluation value) computed by the evaluation value computation means 9 for each elevator. Then, the evaluation value computation means 9 selects the elevator which obtained a minimum value as the assignment evaluation value by comparing each assignment evaluation value, and performs the assignment of the call to the car 3. Incidentally, the function of calculating the assignment evaluation value may be performed by the evaluation value computation means 9. The weighting of each evaluation value may be changed in the computation of the assignment evaluation value.

Upon assignment of a car 3 to the call from the hall destination call registration device 5, the group controller 7 outputs call registration information to the corresponding individual-elevator controller 2 and causes the corresponding elevator to perform a response to the call. The group controller 7 transmits assignment information to the hall destination call registration device 5 in which the call has been registered, and causes the indicator 6 to indicate the information on the assigned car. Also, the group controller 7 causes the call registration storage means 12 to store the contents of the determination of the assigned car determination means 11. Incidentally, the number of assigned calls is stored in the call registration storage means 12 for each car 3 of the elevator.

The group controller 7 configured as described above is provided with priority evaluation value computation means 16 unique to the present group control system, in addition to predicted waiting time evaluation value determination means 14 and other evaluation value computation means 15. The predicted waiting time evaluation value determination means 14 and the above-described other evaluation value computation means 15 are means for computing various kinds of evaluation values which have hitherto been adopted for evaluation purposes in determining the assignment of calls. For example, the predicted waiting time evaluation value determination means 14 computes the predicted period of time during which a passenger must wait for an elevator in the hall 1 on the basis of the information on the present position of the car 3, the information on calls to be responded to, and the like, and outputs the predicted time as a predicted waiting time evaluation value. The above-described other evaluation value computation means 15 computes one or a plurality of evaluation values which have hitherto been used in the evaluation of assignments.

On the other hand, the priority evaluation value computation means 16 has the function of computing the priority whose value is determined according to ease with which a passenger who has registered a call from the hall destination call registration device 5 moves in the hall 1 and ease with which a passenger who later registers a call from the hall destination call registration device 5 moves in the hall 1, and outputs the value as one evaluation value. Specifically, the priority evaluation value computation means 16 determines the above-described priority by increasing or decreasing values on the basis of the number of assigned destination calls for each elevator stored in the call registration storage means 12 and the arrangement of the landing entrance of each elevator in the hall 1.

Also referring to FIGS. 2 to 4, a specific description will be given below of the functions of the group control system having the above-described configuration, in particular, the function of the priority evaluation value computation means 16.

Figure 2:
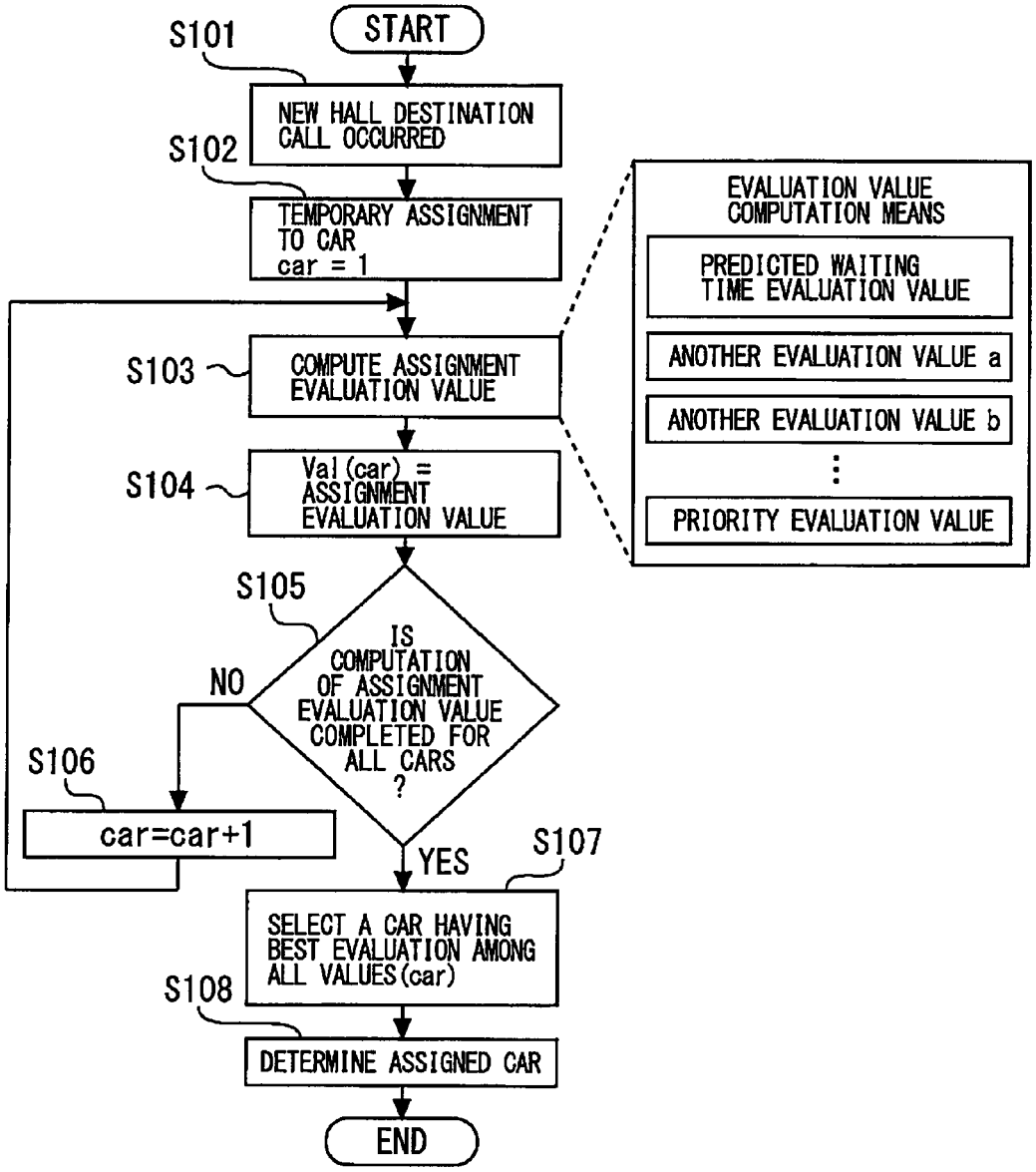
FIG. 2 is a flowchart showing the actions of the elevator group control system in the first embodiment according to the present invention.

FIG. 2 is a flowchart showing the actions of the elevator group control system in the first embodiment according to the present invention. FIG. 3 is a diagram showing the condition of an elevator hall expected when group control is performed through the use of a conventional group control system. FIG. 4 is a diagram showing the condition of an elevator hall expected when group control is performed through the use of the group control system shown in FIG. 1.

When a passenger inputs his or her destination floor to the hall destination call registration device 5, a new call (a hall call and a destination call) occurs (S101), and a request for registration is inputted to a group controller 7. In the group controller 7, when the detection of the call is performed by the call detection means 8, an assignment evaluation value for each elevator is computed by temporarily assigning this call to the car 3 of each elevator.

Specifically, the group controller 7 temporarily assigns the call detected by the call detection means 8 to the car 3A (car=1), whereby the group controller 7 computes each kind of evaluation value and calculates the assignment evaluation value of the car 3A (S102 to S104). Also the group controller 7 makes a determination as to whether or not the computation of the assignment evaluation value has been completed for all cars 3 when the calculation of the assignment evaluation value is finished for one elevator (S105), and the processing in S103 and S104 is repeated until the calculation of all assignment evaluation values is finished (from No of S105 to S106). For example, when the computation of the assignment evaluation value for the car 3A is completed, the car number is increased by one (car=car+1) and the call is temporarily assigned to the car 3B (car=2), whereby each kind of evaluation value is computed and the assignment evaluation value of the car 3B is calculated.

When the computation of the assignment evaluation value is completed for all elevators (Yes in S105), the group controller 7 selects a car 3 having the best evaluation from the computed assignment evaluation values (S107) and assigns the car 3 to the call which occurred in S101 (S108).

Incidentally, the evaluation value computation means 9 performs the computation of the above-described priority evaluation value in addition to the predicted waiting time evaluation value and other evaluation values a, b . . . . For example, for the call which occurred first (that is, in the case where the number of assigned calls of each car 3 which are stored in the call registration storage means 12 is 0), the priority evaluation value computation means 16 determines the priority of each elevator in consideration of the moving distance of this passenger so that the evaluation of the elevator whose landing entrance is arranged on the entrance side of the hall 1 increases, that is, the evaluation value decreases (the elevator whose landing entrance is arranged on the entrance side is more likely to be assigned).

In the case where a plurality of passengers wait in front of the landing entrance of the same elevator (for example, Elevator D) because thereafter the registrations of destination calls of the same destination floor become continuous, the priority evaluation value computation means 16 detects this situation from the storage contents of the call registration storage means 12, and determines the priority of each elevator so that for a passenger who thereafter registers a destination call of the same destination floor, the evaluation value of an elevator whose landing entrance is arranged on the far side of the hall 1 becomes small even when the number of passengers in Elevator D does not reach the rated number of passengers.

Figure 3:
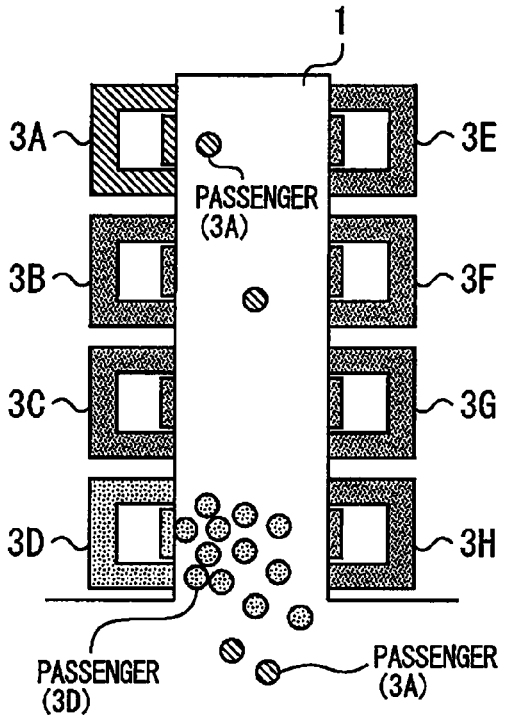
FIG. 3 is a diagram showing the condition of an elevator hall expected when group control is performed through the use of a conventional group control system.

Incidentally, FIG. 3 shows the condition in the above-described specific example, in which for passengers who have registered destination calls of the same destination floor, calls are assigned to Elevator D until the number of passengers reaches the rated number of passengers. In this case, the area near the entrance of the hall 1 becomes congested with the passengers waiting for the arrival of the car 3D, and the passengers who have registered destination calls of other destination floors spend time unexpectedly in moving the far side of the hall 1.

Figure 4:
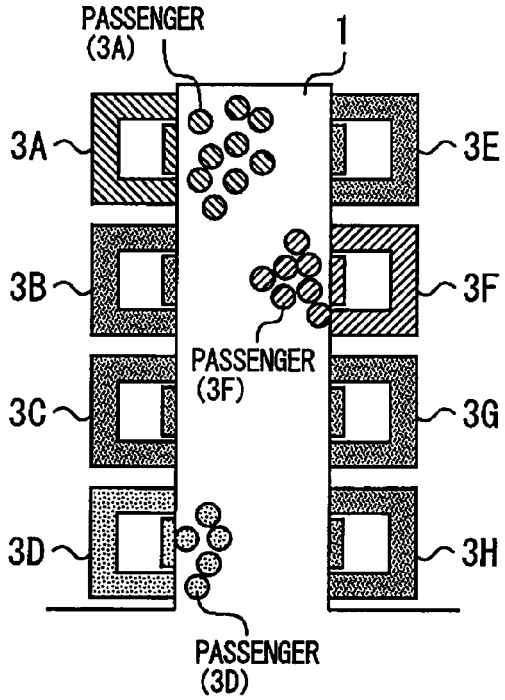
FIG. 4 is a diagram showing the condition of an elevator hall expected when group control is performed through the use of the group control system shown in FIG. 1.

On the other hand, FIG. 4 shows the condition in the above-described specific example, in which the priority of the elevator on the far side of the hall 1 is increased (the priority of the elevator on the entrance side of the hall 1 is decreased) before the number of passengers of Elevator D reaches the rated number of passengers, whereby Elevator A is assigned to destination calls of the same destination floor from a midpoint in time. If this condition is obtained, the number of passengers waiting near the entrance of the hall 1 becomes small, and for the passengers in the hall 1 who have performed registrations later, there is no possibility of their movement being impeded.

In the case where destination calls of other destination floors are registered later, the priority evaluation value computation means 16 detects from the storage contents of the call registration storage means 12 that passengers waiting for the car 3D are present near the entrance of the hall 1, and determines the priority of each elevator so that the movement of the passengers who register calls later is not impeded, for example, so that the evaluation of Elevator H decreases, that is, the evaluation value thereof increases.

FIG. 4 shows the condition which is observed when the above-described destination calls of other destination floors are assigned to Elevator F. In this case, the priority evaluation value computation means 16 detects from the storage contents of the call registration storage means 12 that there are many passengers in front of the landing entrance of each of Elevators A and F, and determines the priority of each elevator, so that the evaluation value of Elevator E, for example, increases for other calls which are registered later.

Incidentally, in the calculation of the assignment evaluation value, it is possible to change the weight of each evaluation value according to the situation, for example, in such a manner as to avoid the congestion in the hall 1 even though the predicted waiting time becomes a little longer thereby.

According to the first embodiment of the present invention, in a group control system for efficiently operating a plurality of elevators, it becomes possible to appropriately control the degree of congestion in the hall 1 also in consideration of the movement of passengers in the hall 1. For this reason, there is no possibility of the area near the entrance of the hall 1 being blocked by the passengers who are waiting for the car 3, and there is no possibility that the passengers will be late for a car due to congestion, impeding efficient operation thereby.

Incidentally, the traffic pattern detection means 13 in the group controller 7 is intended for detecting the expected frequency of occurrence of destination calls for each destination floor on the basis of the calls registered from the hall destination call registration device 5 in the past. On the basis of the predicted frequency of occurrence of destination calls for each destination floor detected by this traffic pattern detection means 13 and the arrangement of the landing entrance of each elevator in the hall 1, the above-described priority evaluation value computation means 16 may compute the above-described priority. In this case, the traffic pattern detection means 13 learns the occurrence frequency of destination calls for each destination floor, for example, for each time period and each of various kinds of traffic patterns, and predicts the occurrence frequency of destination calls.

For example, when it is expected by the traffic pattern detection means 13 that in a prescribed time period the number of destination calls to 14th floor is large and the number of destination calls to the 5th floor is small, upon input of the 14th floor to the hall destination call registration device 5, the priority evaluation value computation means 16 determines the priority of each elevator, in consideration of the movement of the passenger and the passengers who come later in the hall 1, so that the evaluation value of the elevator whose landing entrance is arranged on the far side of the hall 1 decreases. On the other hand, when the 5th floor is inputted to the hail destination call registration device 5, in consideration of the low possibility that a destination call of the 5th floor is successively registered later, the priority evaluation value computation means 16 determines the priority of each elevator so that the evaluation value of the elevator whose landing entrance is arranged on the entrance side of the hall 1 decreases.

Also by this configuration, it is possible to produce the same effect as described above.

Furthermore, in this group control system, it is possible to adopt the configurations described below.

For example the configuration is such that manual setting means 17 is provided in the group controller 7 or outside thereof, and this manual setting means 17 can manually set parameters by use of which the priority evaluation value computation means 16 computes the priority. As a result of this, it is possible to manually set the priority according to various kinds of situations, for example, when a special event is held in the building.

Also, the configuration is such that input means (not shown) for inputting information indicating that the passenger in question is a physically-handicapped person is installed in the hall destination call registration device 5 and it is ensured that at the same time as the registration of his or her destination call this person can input from this input means the information that he himself or she herself is a physically-handicapped person. In this case, when the input means is operated, the priority evaluation value computation means 16 computes the above-described priority also in consideration of the fact that the passenger is a physically-handicapped person (for example, a person who uses a wheelchair). For example, when the above-described input means is operated upon the registration of the call, the priority evaluation value computation means 16 determines the priority of each elevator so that the evaluation value of the elevator whose landing entrance is arranged on the entrance side of the hall 1 decreases.

The group control system can realize optimum control by ensuring that all passengers perform the registration of destination calls from the hall destination call registration device 5. For this reason, in the group control system, the above-described hall destination call registration device 5 may be provided integrally with the security gate through which passengers must pass in entering the hall 1. In this case, on the basis of the information (for example, personal ID) inputted by a passenger in order to open the security gate, the hall destination call registration device 5 is configured to automatically determine the destination floor of the passenger and perform the automatic registration of the call. In this case, the above-described notification device may be installed integrally with the security gate or in the vicinity thereof.

In the above-described system which performs the automatic registration of a call during the passage through the security gate, in the case where the security gate is installed in the vicinity of the hall 1, if many passengers wait near the entrance of the hall 1, the area in front of the security gate may be filled with people, making it difficult for them to pass through the security gate. It becomes possible to prevent this situation also by adopting this control system.

INDUSTRIAL APPLICABILITY

The elevator group control system of the present invention can be applied to systems which perform the operation control of a plurality of elevators on the basis of the destination call registered by a passenger before boarding an elevator car.

REFERENCE SIGNS LIST

1 elevator hall
2A-2H individual-elevator controller
3A-3H car
4A-4H hall door
5 hall destination call registration device
6 indicator (notification device)
7 group controller
8 call detection means
9 evaluation value computation means
10 car position storage means
11 assigned car determination means
12 call registration storage means
13 traffic pattern detection means
14 predicted waiting time evaluation value determination means
15 other evaluation value computation means
16 priority evaluation value computation means
17 manual setting means

The invention claimed is:

1. An elevator group control system which performs operation control of a plurality of elevators, comprising:

a hall destination call registration device by use of which a passenger registers his or her destination call before boarding an elevator car;

an evaluation value computation device which computes a plurality of prescribed kinds of valuation values for each elevator by temporarily assigning a destination call registered from the hall destination call registration device to a car of each elevator; and an assigned car determination device which assigns an optimum car to a destination call registered from the hall destination call registration device on the basis of each of the evaluation values computed by the evaluation value computation device, wherein the evaluation value computation device computes, as one of the plurality of kinds of evaluation values, a priority whose value is determined according to ease with which a passenger who has registered a destination call from the hall destination call registration device moves in a hall and ease with which a passenger who later registers a destination call from the hall destination call registration device moves in the hall.

2. The elevator group control system according to claim 1, further comprising:

a storage device which stores a number of assigned destination calls assigned by the assigned car determination device for each car of the elevators, wherein the evaluation value computation device computes the priority on the basis of the arrangement of the landing entrance of each elevator provided in the elevator hall and the number of assigned destination calls for each car stored in the storage device.

3. The elevator group control system according to claim 2, wherein the hall destination call registration device includes an input device for inputting information indicating that the passenger in question is a physically-handicapped person; and the evaluation value computation device computes the priority also in consideration of the fact that the passenger in question is a physically-handicapped person when the information indicating that the passenger in question is a physically-handicapped person is inputted from the input device during the registration of a destination call.

4. The elevator group control system according to claim 2, further comprising:

a manual setting device for manually setting a parameter for calculating the priority.

5. The elevator group control system according to claim 2, further comprising:

a notification device which is provided integrally with the hall destination call registration device or in a vicinity thereof and notifies the passenger who has registered a destination call from the hall destination call registration device of the assigned car determined by the assigned car determination device, wherein the hall destination call registration device is installed in a vicinity of an entrance of the elevator hall or outside the hall.

6. The elevator group control system according to claim 2, further comprising:

a notification device which notifies the passenger who has registered a destination call from the hall destination call registration device of the assigned car determined by the assigned car determination device, wherein the hall destination call registration device is provided integrally with a security gate through which passengers must pass in entering the elevator hall, and performs automatic registration of a destination call on the basis of the information inputted to open the security gate; and the notification device is provided integrally with the security gate or in a vicinity thereof.

7. The elevator group control system according to claim 1, further comprising:

a detection device which detects expected frequency of occurrence of destination calls for each destination floor on the basis of destination calls registered in the past from the hall destination call registration device, wherein the evaluation value computation device computes priority on the basis of the arrangement of a landing entrance of each elevator provided in the elevator hall and the expected frequency of occurrence of destination calls for each destination floor detected by the detection device.

8. The elevator group control system according to claim 7, wherein the hall destination call registration device includes an input device for inputting information indicating that the passenger in question is a physically-handicapped person; and the evaluation value computation device computes the priority also in consideration of the fact that the passenger in question is a physically-handicapped person when the information indicating that the passenger in question is a physically-handicapped person is inputted from the input device during the registration of a destination call.

9. The elevator group control system according to claim 7, further comprising:

a manual setting device for manually setting a parameter for calculating the priority.

10. The elevator group control system according to claim 7, further comprising:

a notification device which is provided integrally with the hall destination call registration device or in a vicinity thereof and notifies the passenger who has registered a destination call from the hall destination call registration device of the assigned car determined by the assigned car determination device, wherein the hall destination call registration device is installed in a vicinity of an entrance of the elevator hall or outside the hall.

11. The elevator group control system according to claim 7, further comprising:

a notification device which notifies the passenger who has registered a destination call from the hall destination call registration device of the assigned car determined by the assigned car determination device, wherein the hall destination call registration device is provided integrally with a security gate through which passengers must pass in entering the elevator hall, and performs automatic registration of a destination call on the basis of the information inputted to open the security gate; and the notification device is provided integrally with the security gate or in a vicinity thereof.

* * * * *